United States Patent [19]

Suska

[11] 3,999,246

[45] Dec. 28, 1976

[54] TWO KNUCKLE HINGES

[75] Inventor: Charles R. Suska, Roxbury, Conn.

[73] Assignee: The Stanley Works, New Britain, Conn.

[22] Filed: June 30, 1975

[21] Appl. No.: 591,703

Related U.S. Application Data

[62] Division of Ser. No. 508,824, Sept. 24, 1974, Pat. No. 3,903,567.

[52] U.S. Cl. ..... 16/136; 16/189

[51] Int. Cl.[2] ..... E05D 11/04

[58] Field of Search ..... 16/189, 135, 136, 171, 16/128 R, 168, 169, 163–165, 176, 54, 183, 148, 180, 186

[56] References Cited

UNITED STATES PATENTS

| | | | |
|---|---|---|---|
| 2,477,877 | 8/1949 | Jeffrey | 16/168 X |
| 3,015,126 | 1/1962 | Ahlgren | 16/136 X |

*Primary Examiner*—G. V. Larkin

*Attorney, Agent, or Firm*—Brumbaugh, Graves, Donohue & Raymond

[57] ABSTRACT

An improved two knuckle hinge comprises a pair of adjacent hinge leaves on which long and short axially aligned hinge knuckles are formed. The long hinge knuckle houses a bushing in its end adjacent the short hinge knuckle to act as an anti-friction bearing. A torsion spring may also be housed in the portion of the long hinge knuckle unoccupied by the bushing for urging the leaves together. A pintle, about which the long hinge knuckle pivots, is supported in the short hinge knuckle and extends into and cooperates with the torsion spring, when the torsion spring is present in the long knuckle. Also disclosed is a two knuckle hinge that simulates the appearance of a three or more knuckle hinge. This is accomplished through the use of one or more markings such as grooves in the long hinge knuckle which simulate the appearance of gaps between knuckles.

6 Claims, 12 Drawing Figures

FIG. 4
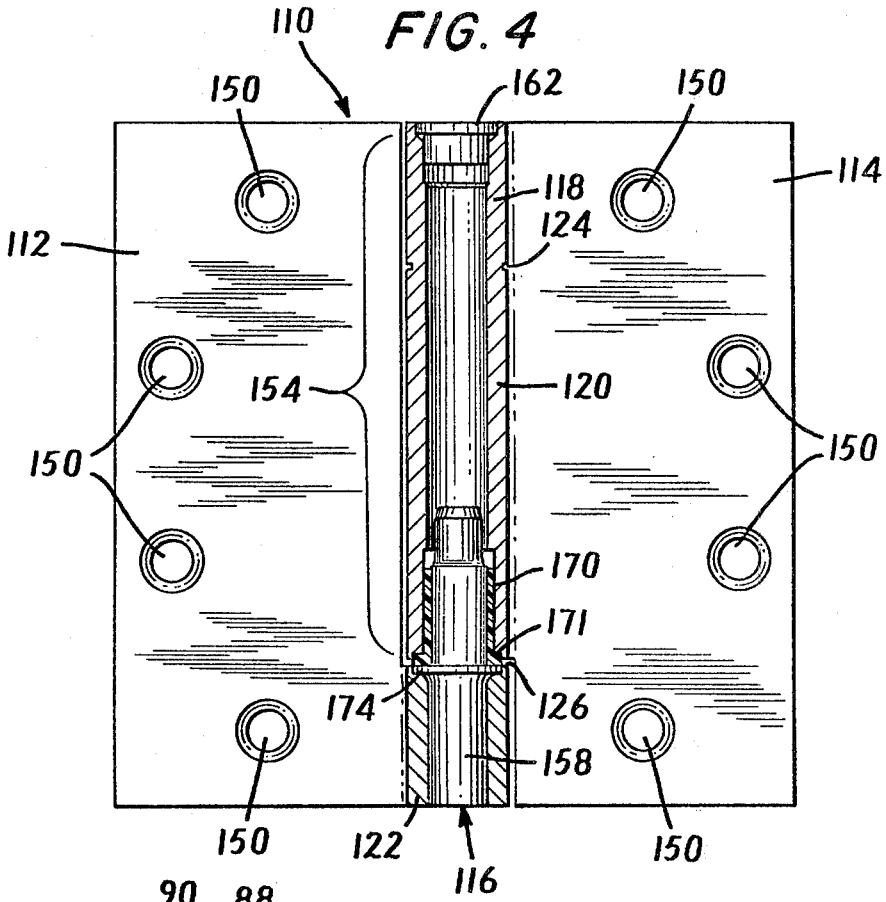
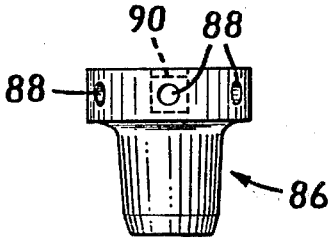
FIG. 9
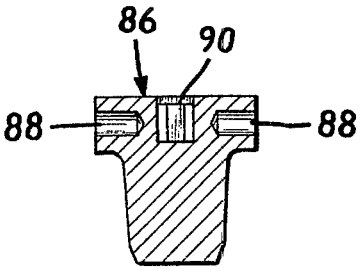
FIG. 11
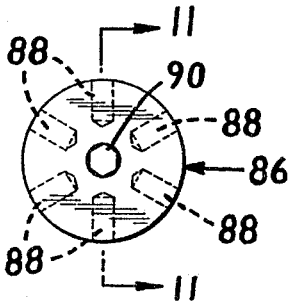
FIG. 10

TWO KNUCKLE HINGES

This is a division, of application Ser. No. 508,824, filed Sept. 24, 1974, now U.S. Pat. No. 3903,567.

FIELD OF THE INVENTION

The present invention relates to two knuckle hinges and, more particularly, to two knuckle spring and non-spring hinges which are capable of simulating the appearance of a three or more knuckle hinges.

BACKGROUND OF THE INVENTION

Doors are often hung using concealed bearing hinges. A typical concealed bearing hinge comprises two hinge leaves, one attached to the door and the other attached to a door jamb such as shown in U.S. Pat No. 3,499,183 to Parsons. Between the two hinge leaves of a typical concealed bearing hinge there is generally a three knuckle barrel, the top and bottom knuckles of which are connected to one of the hinge leaves and the middle knuckle of which is connected to the other hinge leaf. One of the hinge leaves is generally attached with screws to the door and the other hinge leaf is generally attached with screws to the jamb on which the door is hung.

In recent years, some building codes have required new structures, for example, apartment houses, to include door closing devices on the entrance door of each housing unit. While in higher income units concealed hydraulic closers have been utilized, the requirements of the building codes can be satisfied by less expensive spring hinges.

Heretofore, spring hinges have been developed which meet the requirements of the building codes. A spring hinge is a hinge having within its tubular section a torsion spring which urges the door into a closed position. Prior spring hinges have been manufactured with knuckles of large diameter and excessive length, often longer than the leaves, to accommodate a spring sufficiently strong to provide the necessary torque for closing the door. Such hinges have a bulky and unattractive appearance wholly unlike that of concealed bearing hinges or other aesthetically pleasing hinges. Thus, although it has been permissible, under the building codes, to use a bulky spring hinge in conjunction with a concealed bearing hinge, such an arrangement has not generally been accepted for aesthetic reasons. In particular, the reluctance to use the prior spring hinges in combination with a concealed bearing hinge is due primarily to the fact that such prior spring hinges have had an appearance, described above which differs considerably from that of conventional concealed bearing hinges. Thus, if concealed bearing hinges are deemed desirable for aesthetic reasons, a concealed hydraulic door closer must be utilized. On the other hand, if spring hinges are deemed desirable for economic reasons, aesthetics may require that all hinges must be the unattractive bulky spring hinges because of the difference in appearance between them and the concealed bearing hinges.

Conventional two knuckle hinges comprise a pair of knuckles of equal length. If such conventional two knuckle hinges are transformed into a spring hinge, the maximum length of the spring is equal to the length of a knuckle or one half of the total barrel length. This restriction on the length of the spring prevents the use of springs that deliver the requisite torque and spring life. Accordingly, it is imperative that a spring hinge utilize a spring which is long enough to provide adequate torque without impairing either the performance or reliablity of the spring.

SUMMARY OF THE INVENTION

In accordance with the invention, there is provided a novel and improved two knuckle hinge capable of simulating a three or more knuckle hinge, preferably of the concealed bearing type, which normally includes a pair of adjacent hinge leaves and long and short axially aligned hinge knuckles formed respectively on the adjacent edges of the hinge leaves. The hinge of the present invention includes an anti-friction bushing located in the end of the long hinge knuckle adjacent the end of the short hinge knuckle to act as an anti-friction bearing. A torsion spring mechanism may be positioned in the long hinge knuckle for urging the hinge leaves together. A pintle is held and supported by the short hinge knuckle. The pintle, about which the long hinge knuckle pivots, extends through the bushing in the long hinge knuckle and is fastened to one end of the torsion spring mechanism, when the torsion spring mechanism is present in the long hinge knuckle.

A marking such as a groove, which simulates the gap between knuckles, is provided around the exterior of the long hinge knuckle at a distance from its end, equal to the length of the short hinge knuckle so that the two knuckle hinge simulates the appearance of a three knuckle hinge for the aesthetic purposes previously mentioned. Additional markings simulate hinges with a greater number of knuckles. A plug or capstan is also provided in the end of the long hinge knuckle opposite the end housing the bushing. The capstan, which non-rotatably fixes the other end of the torsion spring mechanism in the long hinge knuckle, when the torsion spring mechanism is present in the long hinge knuckle, is also employed to adjust the torsion spring mechanism.

The long hinge knuckle of at least the spring hinge is also provided with an internal shoulder defining an aperture of a diameter smaller than the outer diameter of the torsion spring to prevent inadvertant disassembly of the hinge.

The anti-friction bushing, preferably of a plastic material, is disposed coaxially about the pintle and includes an external flange interposed between the long and short hinge knuckles to provide thrust and lateral bearing surfaces for the hinge. The pintle includes an external flange located in the end of the short hinge knuckle adjacent the long hinge knuckle for providing an anti-friction surface for the flange of the bushing. The flange also provides greater security by preventing driving of the pintle out of one of the knuckles.

The spring hinge of the invention may be used on the same door with the non-spring hinge embodiment of the present invention or with conventional three knuckle hinges. When the spring hinge is used in combination with the non-spring hinge, there is provided an apparatus comprising a plurality of hinges at least one of which is a spring hinge and at least two of which are non-spring hinges. Each of the hinges includes a pair of adjacent hinge leaves, long and short axially aligned hinge knuckles formed respectively on adjacent edges of the hinge leaves, and an anti-friction bushing in the end of the long hinge knuckle adjacent the short hinge knuckle. A flanged pintle, about which the long hinge knuckle pivots, is supported in the short hinge knuckle and extends through the bushing in the long hinge knuckle, the bushing providing thrust and lateral bearing surfaces for the hinges. One or more markings such as grooves extend around the exterior of the long hinge knuckles to have the hinges simulate three or more knuckle hinges.

The spring hinge further includes a torsion spring in the long hinge knuckle for urging the hinge leaves together, means for non-rotatably fixing one end of the torsion spring remote from the short hinge knuckle in the long hinge knuckle, and means for fastening the pintle to the other end of the torsion spring. Thus, a door is hingedly supported on a jamb by a plurality of hinges having the appearance of identical three or more knuckle hinges, and the door is resiliently urged to a closed position.

When the spring hinge is used with three knuckle concealed bearing hinges, there is provided an apparatus for hingedly supporting a door on a jamb by a plurality of hinges having the appearance of three knuckle concealed bearing hinges, and the door is resiliently urged into a closed positon.

Another embodiment of the invention is a double action, two knuckle spring hinge comprising a first hinge leaf, having a long hinge knuckle formed on the one edge thereof; a second hinge leaf adjacent the first hinge leaf, having a short hinge knuckle formed on the edge adjacent the first hinge leaf and axially aligned with the long hinge knuckle of the first hinge leaf, and a long hinge knuckle formed on an opposite edge of the second hinge leaf; and a third hinge leaf adjacent the second hinge leaf, having a short hinge knuckle formed on the edge adjacent the second hinge leaf and axially aligned with the long hinge knuckle of the second hinge leaf. A first bushing is provided in the end of the long hinge knuckle of the first hinge leaf adjacent the short hinge knuckle of the second hinge leaf. Also, a second bushing is provided in the end of the long hinge knuckle of the second hinge leaf adjacent the short hinge knuckle of the third hinge leaf.

A first torsion spring mechanism may be positioned in the long hinge knuckle of the first hinge leaf for urging the first and second hinge leaves together. On end of the first torsion spring mechanism, remote from the short hinge knuckle of the second hinge leaf, is non-rotatably fixed in the long hinge knuckle of the first hinge leaf. Similarly, a second torsion spring mechanism may be provided in the long hinge knuckle of the second hinge leaf for urging the second and third hinge leaves together.

A first pintle, about which the long hinge knuckle of the first hinge leaf pivots, is non-rotatably supported in the short hinge knuckle of the second hinge leaf and extends through the first bushing, whereby the first bushing provides thrust and lateral bearing surfaces for the hinge. The first pintle includes means for fastening the first pintle to the other end of the first torsion spring mechanism. Likewise, a second pintle, about which the long hinge knuckle of the second hinge leaf pivots, is non-rotatably supported in the short hinge knuckle of the third hinge leaf and extends through the second bushing, whereby the second bushing provides thrust and lateral bearing surfaces for the hinge. The second pintle includes means for fastening the second pintle to the other end of the second torsion spring mechanism.

The invention also includes a method of making a two knuckle spring hinge that simulates a three or more knuckle hinge. The method includes the steps of forming a long knuckle on one hinge leaf equal in length to a plurality of knuckles of a multi-knuckle hinge. A short knuckle is formed on the other hinge leaf equal in length to an end knuckle of a multi-knuckle hinge. One or more grooves or markings are provided around the exterior of the long hinge knuckle at a distance from its end, equal in length to the short hinge knuckle. In this manner, the long hinge knuckle is made to simulate a plurality of knuckles of a multi-knuckle concealed bearing hinge by the addition of one or more markings simulating the gap between the long and short knuckle.

The short and long hinge knuckles are aligned and an anti-friction bushing is inserted into the long hinge knuckle to act as a bearing between the knuckles. A torsion spring mechanism, when used, and a pintle are then inserted into the long hinge knuckle, and the hinge is assembled by locking the pintle into the short hinge knuckle in a non-rotatable manner. Torsion is then applied to the spring mechanism by winding, and the spring mechanism is locked into position in the long hinge knuckle. The one or more grooves or markings provided in the long knuckle serves to create the appearance of a multi-knuckle hinge so that the hinge made by this method has the appearance of a three or more knuckle hinge and may be utilized aesthetically with such hinges on one door.

BRIEF DESCRIPTION OF THE DRAWINGS

For a better understanding of the invention, reference may be made to the following description of three exemplary embodiments, taken in conjunction with the figures of the accompanying drawings, in which:

FIG. 4 is an elevation, partially cut away, of the two knuckle non-spring hinge of the present invention;

FIG. 9 is an elevation of the adjustable capstan of the instant invention;

FIG. 10 is a top view of the capstan shown in FIG. 9;

FIG. 11 is a cross-sectional view of the capstan taken along lines 11—11 of FIG. 10.

DESCRIPTION OF THE PREFERRED EMBODIMENTS

Figure 1:
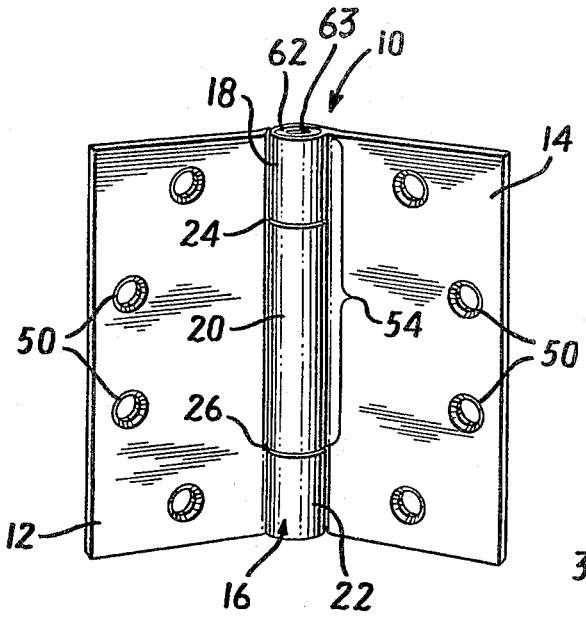
FIG. 1 is a perspective view of the two knuckle spring hinge of the present invention.

Referring generally to FIG. 1, a spring hinge 10 embodying the present invention is shown. The spring hinge 10 comprises a first hinge leaf 12 and a second hinge leaf 14 with a central barrel 16 therebetween. The central barrel 16 is divided into a simulated upper hinge knuckle 18, a simulated middle hinge knuckle 2, and a lower hinge knuckle 22 by a gap 26 and a groove or marking 24 simulating a gap between knuckles.

As will be further explained hereinafter, the central barrel 16 receives a torsion spring 60 which may typically be a coil spring. The spring 60 tends to urge the hinge leaves 12 and 14 together. Thus a door supported by the hinge 10 is resiliently urged to its closed position.

The lower hinge knuckle 22 of the barrel 16 is formed at the edge of the first hinge leaf 12. The simulated upper and middle hinge knuckles 18, 20 are formed at the edge of the second hinge leaf 14. A groove 24 is provided between the upper and middle hinge knuckles 18, 20. The gap 26, extending between the simulated middle and lower hinge knuckles 20, 22, is formed by the juncture of these knuckles 20, 22.

Figure 2:
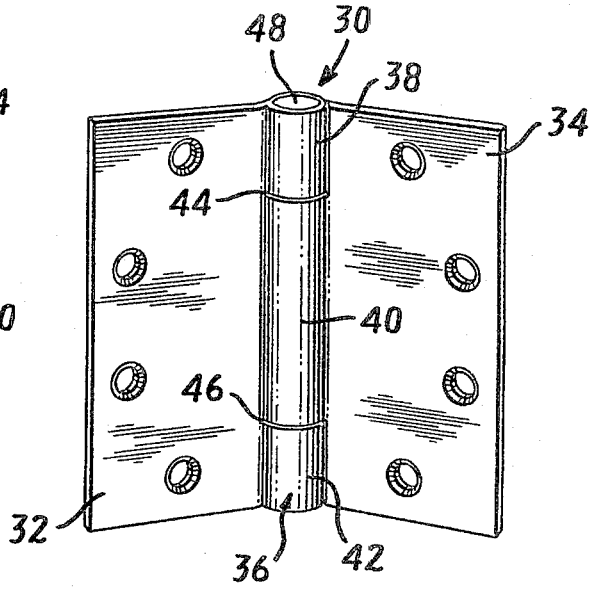
FIG. 2 is a perspective view of a conventional concealed bearing hinge.

Referring generally to FIG. 2, a conventional three knuckle concealed bearing hinge 30 is shown. The concealed bearing hinge 30 comprises a first hinge leaf 32, a second hinge leaf 34, and a central barrel 36. The central barrel 36 is comprised of a top knuckle 38, a middle knuckle 40, and a bottom knuckle 42. Gaps 44, 46 between the middle knuckle 40 and the top and bottom knuckles 38, 42 respectively, are formed by the juncture of the three knuckles 38, 40, 42.

The top and bottom knuckles 38, 42 are formed at the edge of the first hinge leaf 32. The middle knuckle 40 is formed at the edge of the second hinge leaf 34. The hinge leaves 32, 34 are hinged together by aligning the middle knuckle 40 of the second hinge leaf 34 between the top and bottom knuckles 38, 42 of the first hinge leaf 32. A pin 48 is inserted through the top knuckle 38, middle knuckle 40, and bottom knuckle 42 which form the central barrel 36. The pin 48 holds the hinge 30 together and allows the hinge leaves 32, 34 to pivot around the central barrel 36.

Referring again to FIG. 1, the appearance of the spring hinge 10 of the present invention is shown to simulate that of the concealed bearing hinge 30 of FIG. 2. Thus, the spring hinge 10 of the present invention may be utilized aesthetically on a door which also utilizes conventional concealed bearing hinges of the type shown in FIG. 2.

Figure 3:
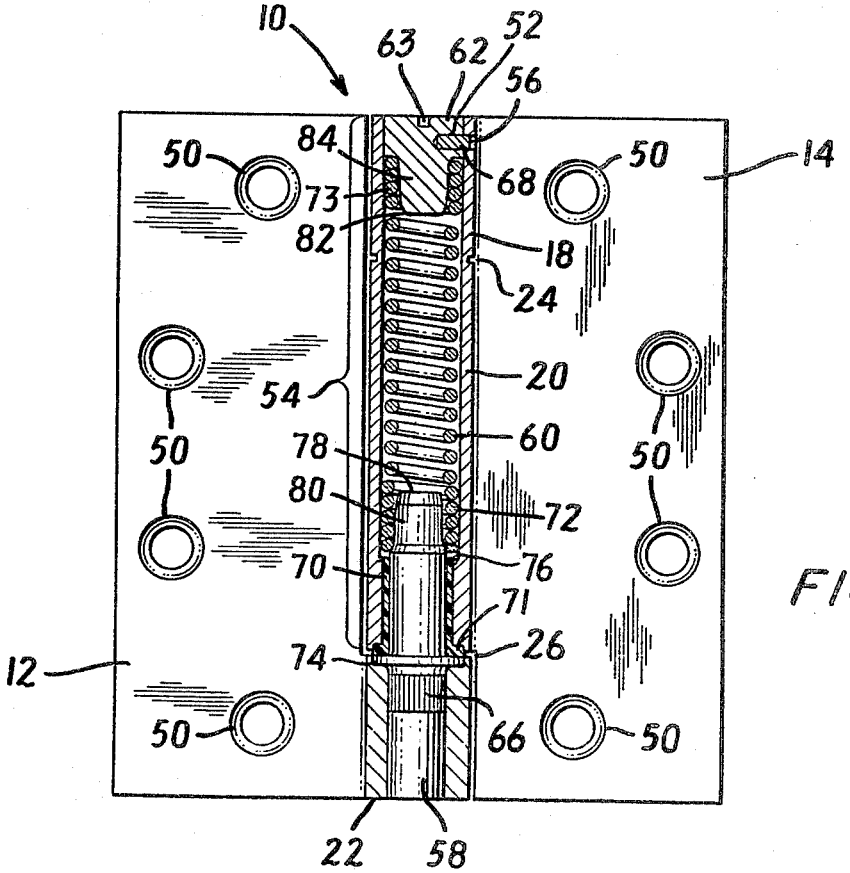
FIG. 3 is an elevation, partially cut away, of the spring hinge shown in FIG. 1.
Figure 5:
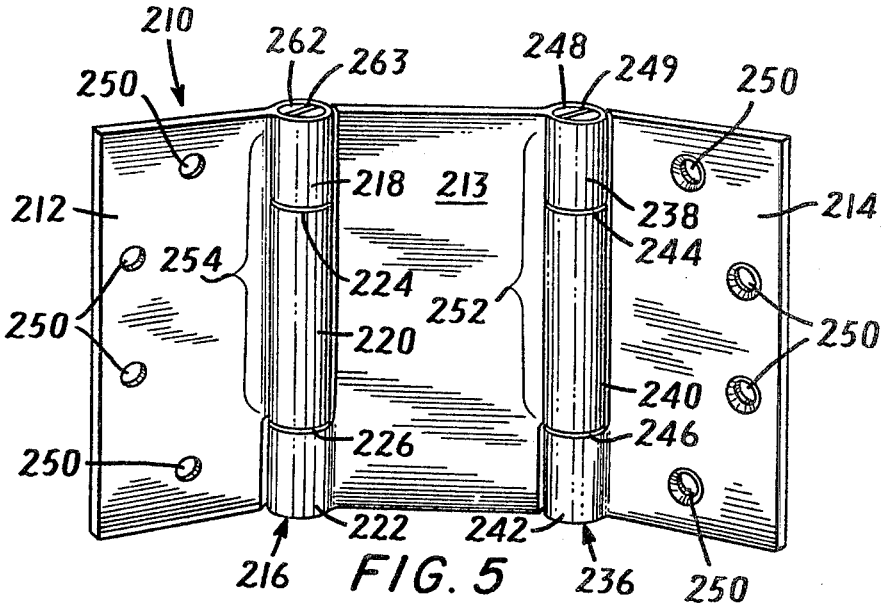
FIG. 5 is a perspective view of a double action two knuckle spring hinge of the present invention.
Figure 6:
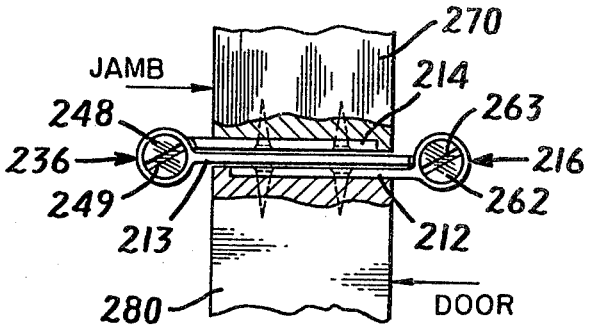
FIG. 6 is a top view, partially cut away, of the double action spring hinge of FIG. 5 shown in a closed position.
Figure 7:
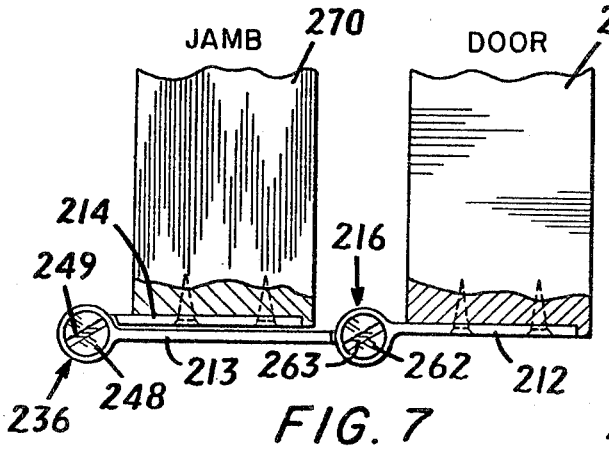
FIG. 7 is a top view, partially cut away, of the double action spring hinge of FIG. 5 shown opened in a counterclockwise direction.
Figure 8:
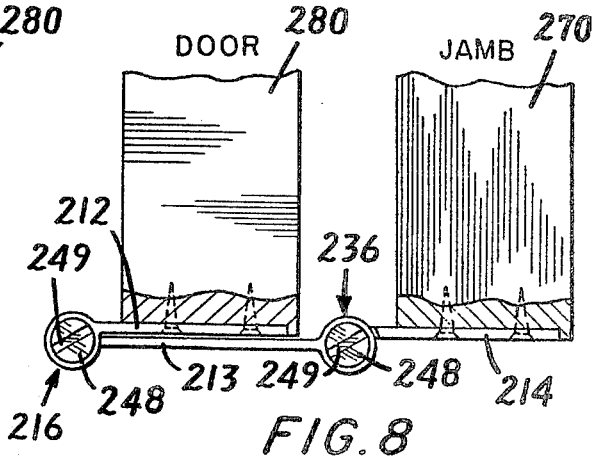
FIG. 8 is a top view, partially cut away, of the double action spring hinge of FIG. 5 shown opened in a clockwise direction.

Referring now generally to FIG. 3, to make the spring hinge 10 of the present invention, the first hinge leaf 12 is formed from a strong material such as steel. A series of countersunk mounting holes 50, adapted to receive screws, are drilled in the hinge leaf12. The short or lower hinge knuckle 22 having a length equal to an end knuckle of a like-sized three knuckle concealed bearing hinge is formed at the lowermost edge of the hinge leaf 12.

In operation, the hinge leaf 12 with the short hinge knuckle 22 is attached to the jamb, while the other hinge leaf 14 is attached to the door. Thus, the short hinge knuckle 22 and its pintle 58, described below, actually support the rest of the hinge in a normal door installation.

The second hinge leaf 14 is formed from the same material as the first hinge leaf 12. The second hinge leaf 14 also is provided with a series of mounting holes 50, countersunk to receive mounting screws. Formed as part of the uppermost portion of the second hinge leaf 14 is the long hinge knuckle 54 having a length equal to the end and a middle knuckle of a like-sized three knuckle concealed bearing hinge. To simulate a three knuckle hinge, the long hinge knuckle 54 is divided into a simulated upper hinge knuckle 18 and a simulated middle hinge knuckle 20 by a marking simulating the gap between knuckles. It will be understood that additional markings may be used to simulate hinges with, for example, five knuckles. In the preferred embodiment the marking is a groove 24 that is cut or coined in the material at a distance from the end of the long hinge knuckle 54 equal in length to the end knuckle of a like-sized three knuckle concealed bearing hinge. The long hinge knuckle 54 has a hole 56 therethrough receiving a small pin 68. The pin 68 extends into and secures a capstan 62 for purposes explained hereinafter. Alternatively, it may be desirable to provide the hole 56 with internal threads capable of receiving a headless set screw rather than a pin.

It is important to include an anti-friction bearing to enable free pivoting of the hinge leaves 12 and 14. In furtherance of this objective, the portion of the long hinge knuckle 54 adjacent the short hinge knuckle 22 is adapted to receive an anti-friction bushing 70. The bushing 70 is essentially a tubular member having a radially extending flange 71 at its end which bears against the short hinge knuckle 22. The end of the long hinge knuckle 54 adjacent the short hinge knuckle 22 is counter-bored to accommodate the flange 71 of the bushing 70. Also, the internal surface of the bushing 70, which is disposed coaxially about the pintle 58, bears directly on the external surface of the pintle 58. Therefore the bushing 70, which is preferably manufactured out of an anti-friction plastic or other anti-friction material, provides both lateral aand thrust bearing surfaces.

To assemble the hinge, the pintle 58 is pressfitted into place in the short hinge knuckle 22 until its flange 74 seats into a counter-bore in the knuckle 22. The pintle 58 is then inserted into the long hinge knuckle 54. Since the pintle 58 is inserted prior to the attachment of the spring 60 thereto, the force required to insert the pintle 58 can be supplied by any suitable tool directly on the end of the pintle 58. This procedure avoids subjecting the spring 60 to the considerable force required to secure the pintle 58 to the short hinge knuckle 22. With the pintle 58 in place, the spring 60 is pressed into position on the pintle and capstan.

The spring 60 includes several closed turns 72, 73 at each end for providing maximum gripping power on the capstan 62 and the pintle 58. By utilizing a spring wound in a direction appropriate to the direction in which the hinge 10 opens, the spring grips the capstan 62 and the pintle 58 with increasing force as the spring torsion increases.

The spring 60 is secured to the pintle 58 by providing the end of the pintle 58 extending into the long hinge knuckle 54 with a taper. A chamfer 78 at the end of the pintle 58 facilitates insertion of the pintle 58 into the spring 60, while the tapered portion 80 of the pintle 58 expands the closed turns 72 of the spring 60. After the spring 60 is forced onto the pintle 58, the winding of the spring 60, to be described more fully hereinbelow, causes it to more tightly grip the pintle 58. A knurled portion 66 of the pintle 58 grips the interior of the short hinge knuckle 22 to secure the pintle 58 in the short hinge knuckle 22 after the pintle 58 is pressed into position. Alternatively, the pintle 58 may be secured in the short hinge knuckle 22 by a pin in a manner similar to that by which the capstan 62 is secured in the long hinge knuckle, described hereinafter.

The capstan 62 is then inserted into the long hinge knuckle 54 of the second hinge leaf 14. A hole 52 in the capstan 62, aligned with the hole 56 in the long hinge knuckle 54 by drilling the holes together or by drilling through the hole 56, receives the small pin 68 slip fitted through the hole 56 in the long hinge knuckle 54 and into the hole 52 in the capstan 62 to secure the capstan 62 in place after the spring 60 has been wound to the proper torque value. The capstan 62, like the pintle 58, is provided with a taper for securing the spring 60 to the capstan 62. A chamfer 82 at the end of the capstan 62 extending into the long knuckle 54 facilitates insertion of the capstan into the spring, while the tapered portion 84 of capstan 62 expands the closed turns 73 of the spring 60.

To wind the spring 60, the jamb leaf 12 is held while a drive device cooperating with a recess 63 in the capstan 62, for example a screwdriver inserted into a slot is used to rotate the capstan. After the spring 60 has been wound to the proper torque value, and the hole 53 drilled as discussed above the small pin 68 is inserted through the long hinge knuckle 54 and into the capstan 62 to secure it in place. The torque on the pin 68 created by the torsion of spring 60 prevents its inadvertent movement.

To prevent disassembly of the hinge 10 and unauthorized removal of the door, the long hinge knuckle 54 is provided with an internal shoulder 76. The outer diameter of the spring 60 is greater than the diameter of an opening defined by the shoulder 76. As a result, the spring 60 cannot pass through the smaller diameter opening defined by the shoulder 76, and the hinge knuckles 22, 54 are effectively held together.

Furthermore, the pintle 58 is provided with the flange 74 by a turning or upset operation. The flange 74 is positioned in the counter-bored portion of the end of the short hinge knuckle 22 adjacent the bushing 70. Thus, not only does the flange 74 prevent the pintle 58 from being driven out of either knuckle, but it also provides a bearing surface for the flange 71 of the bushing 70.

The two knuckle spring hinge 10 thus formed simulates the appearance of the three knuckle concealed bearing hinge of FIG. 2. The provision of the groove 24 in the long hinge knuckle 54 divides that section into a simulated upper hinge knuckle 18 and a simulated middle hinge knuckle 20. With the groove 24 and the gap 26 between the long knuckle 54 and the short knuckle 22, the hinge 10 has the appearance of and cannot readily be distinguished from the concealed bearing hinge 30. Thus, unlike prior spring hinges, the spring hinge 10 of the present invention may be aesthetically utilized in conjunction with three knuckle concealed bearing hinges of the type 30 shown in FIG. 2.

It should be understood that it is possible to form the marking 24 by cutting a groove. Alternatively, if the hinge is made by blanking and forming wrought metal, for example, the groove 24 may be coined in a flat blank prior to forming the long hinge knuckle 54. Or the marking 24 may be provided in any other desired manner.

Referring now generally to FIGS. 9–11, in the event that a spring hinge adapted for field adjustment is desired, a plurality of circumferentially spaced holes are drilled radially into the capstan. The number of holes provided depends upon the fineness of torsional adjustment desired. Thus, provision of two diametrically opposed holes allows the capstan to be turned 180° in either a counterclockwise direction or a clockwise direction to adjust the tension on the spring. If six spaced holes 88 are employed, as shown in FIGS. 9–11, the capstan 86 may be turned in increments of 60° in either a counterclockwise or clockwise direction, thereby providing for finer adjustments of the spring. Also, the rectangular slot 63 in the capstan 62 of FIGS. 1 and 3 may be replaced with a hexagonal slot 90 so that the capstan 86 may be adjusted by means of an Allen wrench rather than a screwdriver.

It is permissible, under some building codes, to hang lighter weight doors by one spring hinge and two conventional butt hinges. For heavier doors, two or three spring hinges would be used as required. When spring and non-spring hinges are used together on the same door, they must be similar in basic dimensions to maintain proper door action and for aesthetic purposes. To achieve optimum mechanical compatability, it may be desirable to utilize a non-spring and aesthetic counterpart of the spring hinge of FIG.1 with such spring hinge.

Referring now to FIG. 4, there is shown a non-spring hinge 110, which is a counterpart of the spring hinge 10 of FIGS. 1 and 3 described above. The non-spring hinge 110 comprises a first hinge leaf 112 and a second hinge leaf 114 with a central barrel 116 therebetween. The central barrel 116 is divided into a simulated upper hinge knuckle 118, a simulated middle hinge knuckle 120 and a lower hinger knuckle 122 by a gap 126 and a marking 124 such as a groove simulating a gap.

The lower or short hinge knuckle 122 of the barrel 116 is formed at the edge of the first hinge leaf 112. The simulated upper and middle hinge knuckles 118 and 120 are formed at the edge of the second hinge leaf 114. The hinge leaves 112, 114 include a series of countersunk mounting holes 150, adapted to receive screws.

As in the spring hinge 10, it is important to have an anti-friction bearing included to enable the hinge leaves 112, 114 to pivot freely. Therefore, the portion of the long hinge knuckle 154 adjacent the short hinge knuckle 122 is adapted to receive an anti-friction bushing 170. The bushing 170 is essentially a tubular member having a radially extending flange 171 at the end of the bushing 170 which bears against the short hinge knuckle 122. The end of the long hinge knuckle 154 adjacent the short hinge knuckle 122 is counter-bored to accomodate the flange 171 of the bushing 170. Also, the internal surface of the bushing 170, which is disposed coaxially about a pintle 158, bears directly on the external surface of the pintle 158. Therefore, the bushing 170 provides both lateral and thrust bearing surfaces.

A plug or capstan 162 of the non-spring hinge 110 is generally of the type of the capstan 62 of the spring hinge 10. However, the capstan 162 is pressed into the long hinge knuckle 154 rather than pinned. The pintle 158 is also similar to the pintle 58 of the spring hinge 10, although it need not have a knurled portion, so that the flange 174 is positioned in a counter-bored portion of the end of the short hinge knuckle 122 adjacent the bushing 170. Not only does the flange 174 prevent the pintle 158 from being driven out of either hinge knuckle, but it also provides a bearing surface for the flange 171 of the bushing 170. However, since there is no spring in the long hinge knuckle 154, the knuckle 118 need not be bored out to receive such spring, and the non-spring hinge 110 is separable. Thus, the long hinge knuckle 154 of the hinge leaf 114 may be lifted off or lowered onto the pintle 158 which is press fitted into the short hinge knuckle 122 of the hinge leaf 112.

Figure 12:
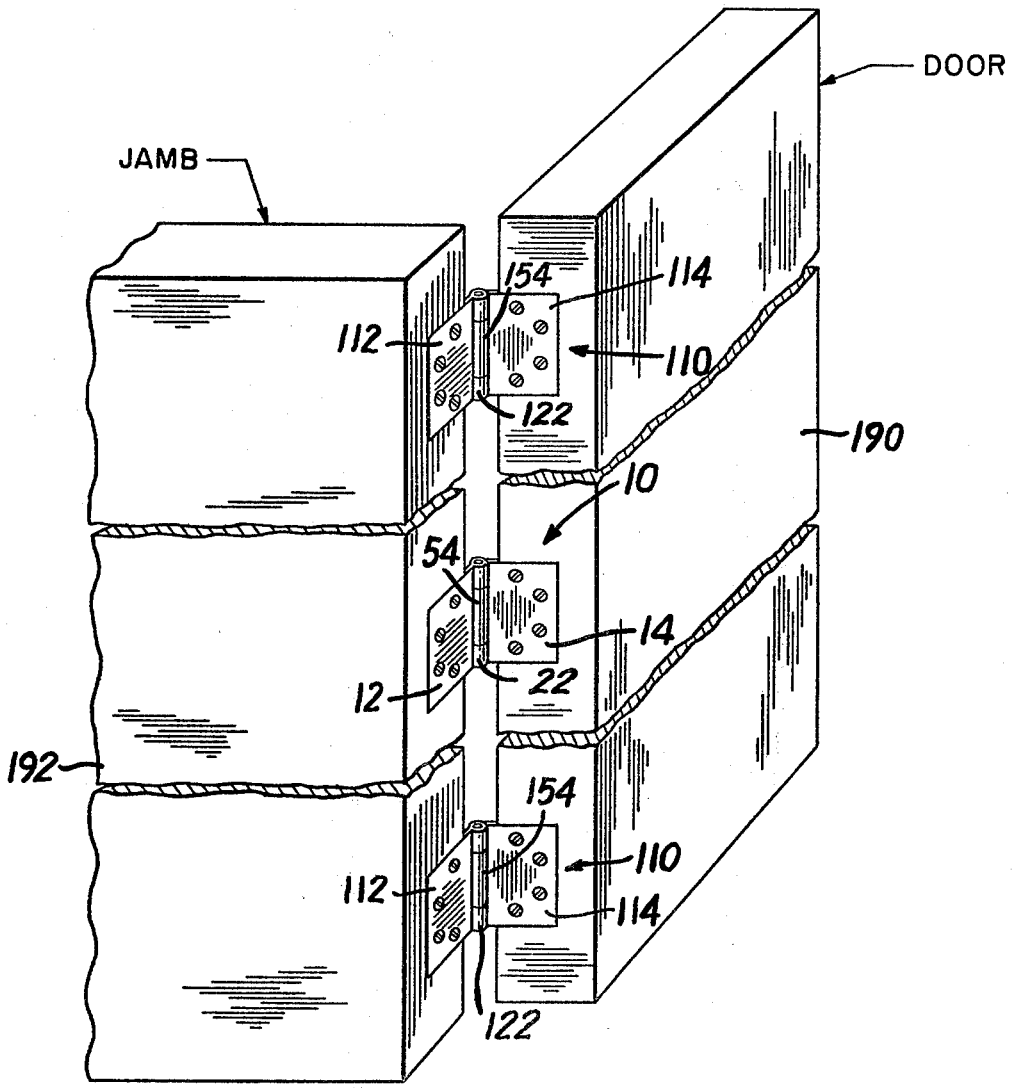
FIG. 12 is a perspective view of a door hung on a jamb by one spring hinge and two non-spring hinges, all identical in appearance, in accordance with the invention.

Referring now to FIG. 12, there is shown a door 190 hung from a jamb 192 by a spring hinge 10 positioned between a pair of non-spring hinges 110, 110. The hinge leaf 14 of the spring hinge 10 is attached to the door 190, while the hinge leaf 12 of the spring hinge 10 is attached to the jamb 192. When the non-spring hinges 110, 110 are used on the same door as the spring hinge 10, the hinge leaves 114, 114 with the long hinge knuckle 154 are attached to the door 190, while the hinge leaves 112, 112 with the short hinge knuckle 122 are attached to the jamb 192. Thus, optimum mechanical and aesthetic compatibility is achieved.

In assembling the hinges to the door and jamb, the hinges 110, 110 are readily disassembled, the hinge leaves 112, 112 are disassembled from hinge leaves 114, 114 and attached to the jamb 192. Similarly, the separated hinge leaves 114, 114 are attached to the door 190 which may be located remote from the jamb 192. After attachment of the hinge leaves 112, 112 to the jamb 192 and the hinge leaves 114, 114 to the door 190, the door 190 can be readily hung on the jamb 192 by simply positioning the door 190 such that the long hinge knuckles 154, 154 are above and in alignment with the pintles 158, 158 (see FIG. 4) in the short hinge knuckles 122, 122. The door 190 is then juxtaposed with the jamb and lowered in such a manner that the long hinge knuckles 154, 154 are lowered onto the pintles 158, 158 (see FIG. 4). Note that the chamfer and taper on ends of the pintles protuding from the short hinge knuckles on the jamb help lead the pintles into the long hinge knuckles on the door. Finally, the hinge leaf 14 and the hinge leaf 12 of the spring hinge 10 are simply and easily attached to the door 190 and the jamb 192, respectively, between the non-spring hinges. Thus, utilization of the two knuckle non-spring hinges 110, 110 in conjunction with a spring hinge 10 facilates hanging the door 190 on the jamb 192. The invention also contemplates using conventional concealed bearing hinges in place of the non-spring hinges 110, 110.

Referring now to FIGS. 5–8, there is shown a double action spring hinge 210 capable of permitting a door 280 mounted thereon to rotate 180° in either a clockwise or counterclockwise direction. The double action spring hinge 210 comprises a first hinge leaf 212 and a second hinge leaf 213 with a barrel 216 therebetween. The barrel 216 is divided into a simulated upper hinge knuckle 218, a simulated middle hinge knuckle 220 and a lower hinge knuckle 222 by a gap 226 and a marking 224 such as a groove simulating a gap. The double action spring hinge 210 further comprises a third hinge leaf 214 with a barrel 236 between it and the second hinge leaf 213. The barrel 236 is divided into a simulated upper hinge knuckle 238, a simulated middle hinge knuckle 240, and a lower hinge knuckle 242 by a gap 246 and a marking 244 simulating a gap. The first hinge leaf 212 and the third hinge leaf 214 are provided with a series of countersunk mounting holes 250, adapted to receive screws, as indicated by the dotted lines in FIGS. 6–8.

Similar to the single action spring hinge of FIGS. 1 and 3, the barrels 216, 236 each receive a torsion spring (not shown) of the type used in the spring hinge of FIG. 3. The spring located in the barrel 216 tends to urge the hinge leaves 212, 213 together, while the spring located in the barrel 236 tends to urge the hinge leaves 213, 214 together. To provide these actions, the springs have different hands. Thus, a door 280 supported by the hinge 210 may be automatically closed whether it is swung open in a clockwise or counterclockwise direction.

The long hinge knuckle 254 of the first hinge leaf 212 and the long hinge knuckle 252 of the second hinge leaf 213 accommodate capstans 262, 248, respectively, which are similar in construction to the capstan of the single action spring hinge 10 of FIGS. 1 and 3. Thus, the capstans 262, 248 are provided with slots 263, 249, respectively, for adjusting the torsion of the springs (not shown) located in the long hinge knuckles 254, 252, respectively, of the hinge 210. The short hinge knuckles 222, 242 also house pintles (not shown) which are similar in construction to the pintle of the single action spring hinge of FIGS. 1 and 3. It should be noted that the adjustable capstan of FIGS. 9–1 may also be utilized in place of the capstans 262, 248.

In operation, the hinge leaf 212 with the long hinge knuckle 254 is screwed to the door 280, while the hinge leaf 214 with the short hinge knuckle 242 is screwed to the jamb 270. Thus, the short hinge knuckle 242 and its pintle actually support the rest of the double action hinge in a normal door installation.

It should be understood that the non-spring embodiment of FIG. 4 and the double action embodiment of FIGS. 5–8 may be manufactured from the same materials and in the same manner as the single action spring hinge of FIGS. 1 and 3. Also, the same method may be employed to simulate a five knuckle hinge or a hinge having any number of knuckles as mentioned heretofore.

It will be understood that the above described embodiments are merely exemplary and that those skilled in the art may make may variations and modifications without departing from the spirit and the scope of the invention. All such modifications and variations are intended to be within the scope of the invention as defined in the appended claims.

I claim:

1. A two knuckle hinge comprising:
   - a pair of adjacent hinge leaves, long and short axially aligned hinge knuckles formed respectively on the adjacent edges of said hinge leaves;
   - an anti-friction bushing in the end of said long hinge knuckle adjacent said short hinge knuckle for providing thrust and lateral bearing surfaces for the hinge; and
   - a pintle, about which said long hinge knuckle pivots, supported in said short hinge knuckle and extending through said bushing in said long hinge knuckle, a flange on said pintle positioned between said long and short hinge knuckles and in contact with said bushing for providing an anti-friction surface for said bushing and for preventing said pintle from being driven out of said hinge knuckles.

2. A hinge according to claim 1, wherein said long hinge knuckle further includes at least one marking simulating a gap between two hinge knuckles extending around the exterior of said long hinge knuckle at a distance from its end equal to the length of said short hinge knuckle, whereby the two knuckle hinge simulates a three or more knuckle hinge.

3. A hinge according to claim 1, wherein said hinge leaves are equal in length to the leaf of a conventional concealed bearing hinge, the length of said short hinge knuckle is equal to the length of a short hinge knuckle of a concealed bearing hinge, and the combined length of said long and short hinge knuckles is equal to the length of said hinge leaves, whereby the two knuckle hinge simulates a three knuckle concealed bearing hinge.

4. In a two knuckle hinge having a pair or adjacent hinge leaves and long and short axially aligned hinge knuckles formed respectively on the adjacent edges of the hinge leaves, the improvement comprising:

anti-friction means including a bearing;

pin means extending from said short hinge knuckle through said anti-friction means into long hinge knuckle and connecting said knuckles in end to end relationship for pivotal movement on said bearing about said pin means; and means integral with said long hinge knuckle for causing the two knuckle hinge to simulate the appearance of a three or more knuckle hinge.

5. A hinge according to claim 4, wherein said hinge leaves are equal in length to the leaf of a conventional concealed bearing hinge, the length of said short hinge knuckle is equal to the length of a short hinge knuckle of a concealed bearing hinge, and the combined length of said long and short hinge knuckles is equal to the length of said hinge leaves, whereby the two knuckle hinge simulates a three knuckle concealed bearing hinge.

6. A hinge according to claim 4, wherein said means integral with said long hinge knuckle includes a marking simulating a gap between two hinge knuckles extending around the exterior of said long hinge knuckle at a distance from its end equal to the length of said short hinge knuckle.

* * * * *

UNITED STATES PATENT AND TRADEMARK OFFICE

CERTIFICATE OF CORRECTION

PATENT NO. : 3,999,246

DATED : December 28, 1976

INVENTOR(S) : CHARLES R. SUSKA

It is certified that error appears in the above-identified patent and that said Letters Patent are hereby corrected as shown below:

Col. 3, line 24, delete "the";

Col. 4, line 66, "2" should read --20--;

Col. 5, line 23, "juncture" should read --junctures--;

Col. 5, line 46, "leaf12" should read --leaf 12--;

Col. 6, line 28, "aand" should read --and--;

Col. 6, line 30, "pressfitted" should read --press fitted--;

Col. 7, line 14, after "slot" insert --,--;

Col. 7, line 16, "53" should read --52--;

Col. 7, line 17, after "above" insert --,--;

Col. 8, line 25, "hinger" should read --hinge--;

Col. 9, line 29, "protuding" should read --protruding--;

Col. 9, line 37, "facilates" should read --facilitates--;

Col. 10, line 16, "FIGS. 9-1" should read --FIGS. 9-11--;

Col. 10, line 34, "may" (second occurrence) should read --many--;

Col. 11, line 4, "or" should read --of--; and

Col. 11, line 10, after "into" insert --said--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*